United States Patent [19]

Brotz

[11] 4,012,038

[45] Mar. 15, 1977

[54] MAGNETIC TOY

[76] Inventor: Gregory R. Brotz, 25 N. Point Drive, Sheboygan, Wis. 53081

[22] Filed: Mar. 3, 1976

[21] Appl. No.: 663,463

[52] U.S. Cl. ..... 273/1 M; 40/106.45; 46/47; 46/238; 272/31 R

[51] Int. Cl.[2] ..... A63F 9/00

[58] Field of Search ..... 273/1 R, 1 M, 1 E, 85 A; 272/31 R; 40/106.45; 46/234, 235, 236, 238, 47

[56] References Cited

UNITED STATES PATENTS

| | | | |
|---|---|---|---|
| 622,545 | 4/1899 | Schoknecht et al. | 46/239 |
| 1,966,686 | 7/1934 | Russ | 40/106.45 |
| 2,280,623 | 4/1942 | Broomfield | 273/1 E |
| 2,282,430 | 5/1942 | Smith | 40/106.45 |
| 2,979,861 | 4/1961 | Staaf | 46/239 |
| 3,136,544 | 6/1964 | Strayer | 46/239 X |
| 3,476,386 | 11/1969 | Bart | 273/1 R X |
| 3,627,316 | 12/1971 | Machinski | 273/1 M |
| 3,908,307 | 9/1975 | Jacobson | 273/1 M X |

*Primary Examiner*—William H. Grieb
*Attorney, Agent, or Firm*—William Nitkin

[57] ABSTRACT

A toy for use by one or more players utilizing magnetic repulsion and attraction consisting of a casing, a pivotal member rotatably mounted on top of the casing having a plurality of apertures in its periphery into which are inserted one or more pivotal member rods each having a bar magnet rotatably mounted at its end. Extending from the casing below the pivotal member are one or more lower rods each having a bar magnet mounted at its end positioned in such a way that when the pivotal member revolves, the bar magnet on the pivotal member rod passes directly over the bar magnet mounted on the lower rod. When both the pivotal member bar magnet and the lower rod bar magnet have like poles in close proximity, magnetic repulsion will cause the pivotal member to revolve.

8 Claims, 3 Drawing Figures

MAGNETIC TOY

BACKGROUND OF THE INVENTION

1. Field of the Invention

The invention disclosed herein is a magnetic toy for use by one or more players utilizing magnetic repulsion and attraction of like and opposite poles of bar magnets to cause revolving movement of a pivotal member.

2. Description of the Prior Art

Games based on magnetic repulsion and attraction have been in existence for a long time. In their simplest form such games consist of two bar magnets which are manipulated so that when like poles are in close proximity to each other, they repulse each other; and when opposite poles are close to each other, they attract each other. Such bar magnets have been incorporated into simple toys, for example, with little dogs located on top of bar magnets. Magnetic games have been developed such as "fishing" games where a player utilizes a magnet to lift magnetized pieces of the game. Magnetic games, further, have incorporated like-pole repulsion to flip elements on a game board. Bar magnets have also been mounted in association with other bar magnets whereby one magnet by repulsion or attraction causes different effects within the various games in which they are employed. Electronic magnets have often been used in games both to lift objects and, in the well known magnetic football games, to move player-pieces having magnets at their bases along a metallic surface.

SUMMARY

The device of this invention consists of a manually-controlled toy which incorporates magnetic repulsion and attraction to test a player's timing, coordination and dexterity. The object of the game is to cause a pivotal member to revolve using magnetic repulsion as the sole source of propulsion. This toy can be used by an individual for his own amusement or played in a game setting by two or more individuals. The device is comprised of a casing of plastic or equivalent non-magnetic material. The casing extends from a base to a neck section. Inserted into the top of the neck section is the shaft of a rotatable pivotal member. Inserted within the periphery of the pivotal member is a plurality of non-magnetic rods of equal length. At the end of each of these pivotal member rods is mounted a manually-rotatable bar magnet. Extending out of the neck section of the casing below the pivotal member is a pair of rotatable rigid non-magnetic lower rods at the ends of which are rotationally-mounted bar magnets. The rotation of each lower rod and its attached bar magnet is controlled by a control knob located at the base of the casing. The rotation of each lower rod and its associated bar magnet is accomplished by manually turning the control knob which is attached to a control shaft. The control shaft connects a first pulley with the control knob. A belt connects the first pulley with a second pulley which turns a casing shaft. At the top of the casing shaft is a first bevel gear which is connectively associated with a second bevel gear located at a right angle to the first bevel gear, the second bevel gear being attached to the lower rod so that when the control knob is turned, the lower rod rotates. The circumference of the first pulley is twice the circumference of the second pulley so that when the control knob is turned 90°, the bar magnet at the end of the lower rod rotates 180° causing, for example, the positive pole of the lower bar magnet to face upward from a downward-facing position. If a bar magnet at the end of a pivotal member rod is directly above a lower bar magnet, the magnets will be either attracted or repelled depending upon the polarity of the poles that are facing each other. The lengths of both the pivotal member rods and the lower rods are of a length to enable the pivotal member bar magnets to revolve over the lower bar magnets. The pivotal member rods can be composed of a rigid or flexible non-magnetic material. A flexible rod would have a tendency to bend either toward or away from the lower rod depending upon the polarity of the poles of the pivotal member bar magnet and the lower bar magnet that are in close proximity to one another. By skillfully turning the control knob governing each lower rod, a player can repel the pivotal member bar magnet and maintain a horizontal revolving movement of the pivotal member structure. It is anticipated that a one-way ratchet and pawl could be located between the neck section and the pivotal member so as to create a one-way rotational movement, the direction of movement dependent upon the position of the pawl. Each pivotal member bar magnet is manually rotatable to make the game more interesting by varying the sequence of the poles so that the lower bar magnet must be quickly rotated by means of its control knob so as not to have an opposing pole facing upward and stopping the motion of the pivotal member. The pivotal member bar magnets can also be positioned horizontally with either the negative pole advancing first over the lower bar magnet or the positive pole advancing first over the lower bar magnet. If a pivotal member bar magnet is in a horizontal position, a player in order to maintain movement of the pivotal member can attract the pivotal member bar magnet with an opposing pole by appropriately turning the control knob of the lower rod, and then repel the pivotal member bar magnet by a like pole facing the rear of the pivotal member bar magnet as it passes over. It is further anticipated that the bar magnets can be electromagnetic with a player-operated variable control so that a player can increase the opposing force of a bar magnet to cause faster revolutions of the pivotal member. It is further anticipated that the pivotal member can have ball bearings located under it to lessen the friction caused by the revolving pivotal member.

DESCRIPTION OF THE PREFERRED EMBODIMENT

Figure 1:
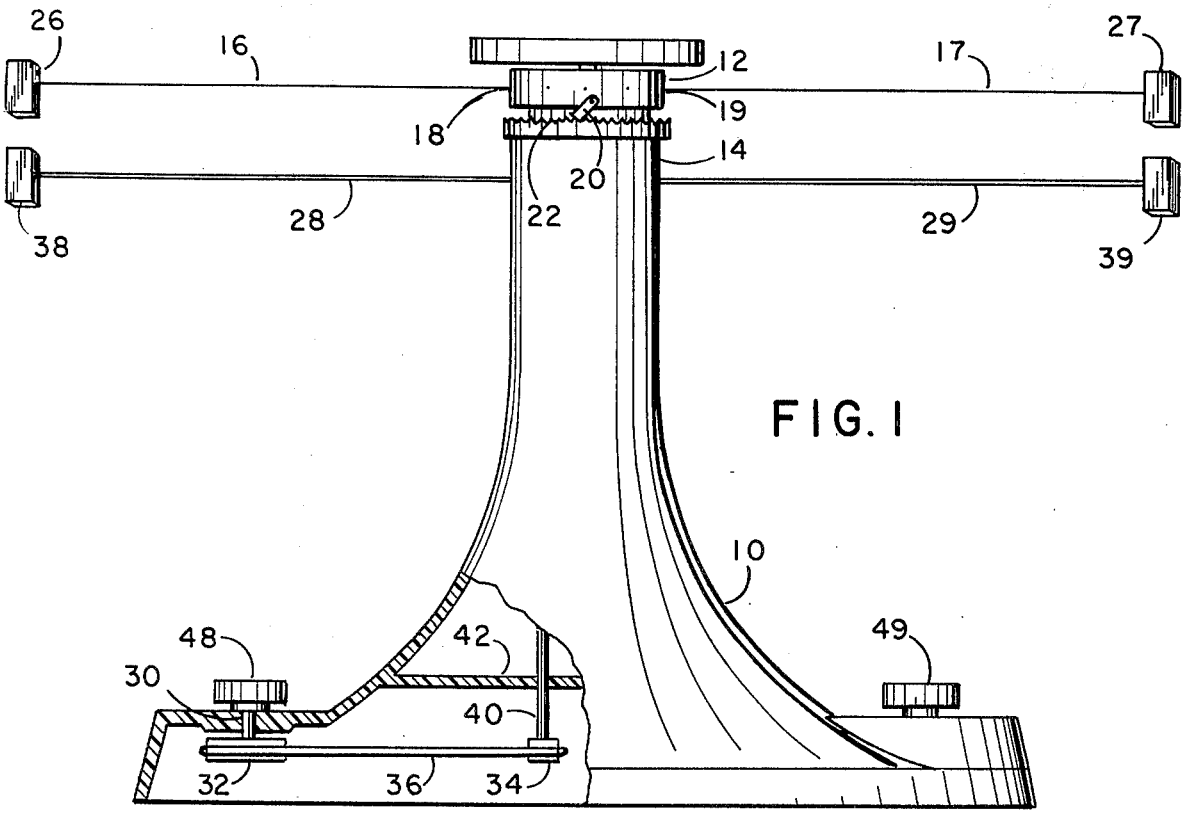
FIG. 1 illustrates a front view of the apparatus of this invention.

FIG. 1 illustrates a front view of the apparatus of this invention with part of the lower portion of the casing cut away to expose inner structure. At the top of casing 10 is pivotal member 12 which is rotationally mounted atop neck section 14 of casing 10. Along the circumference of pivotal member 12 is a plurality of apertures for receipt of one end of pivotal member rods 16 and 17. Pivotal member rods 16 and 17 are shown inserted respectively at apertures located at points 18 and 19. The rotation of pivotal member 12 is unidirectional, its direction determined by a stationary toothed ratchet 22 engaged by an adjustable pawl 20 located on pivotal member 12. At the other ends of pivotal member rods 16 and 17 are rotatably-mounted pivotal member bar magnets 26 and 27. These pivotal member bar magnets can each have an aperture at their midsections for insertion of the pivotal member rod or each can be affixed by other means to its respective pivotal member rod. Pivotal member bar magnets can be manually rotated so that their positive and negative poles are facing either upward or downward as desired by the player. In the embodiment illustrated, rigid lower rods 28 and 29 extend from opposite sides of neck section 14 below pivotal member rods 16 and 17. In another embodiment of the apparatus of this invention only one lower rod can be utilized. Lower rods 28 and 29 have lower bar magnets 38 and 39 affixed to their respective ends. It should be noted that the lengths of lower rods 28 and 29 and pivotal member rods 16 and 17 are such that lower bar magnets 38 and 39 are directly under pivotal member bar magnets 26 and 27 when pivotal member 12 revolves horizontally. It is anticipated that the vertical distance between a pivotal member bar magnet and a lower bar magnet will be such that the magnetic field of one will have influence on the other and vice versa. The rotation of each lower rod 28 and 29 is controlled respectively by control knobs 48 and 49. The mechanism of control knob 48 is partially illustrated in the cut-away view of FIG. 1. Control knob 48 communicates by control shaft 30 to first pulley 32 which controls the rotation of second pulley 34 by belt 36. Second pulley 34 is affixed to the base of casing shaft 40 which runs upward through support member 42 within casing 10.

Figure 2:
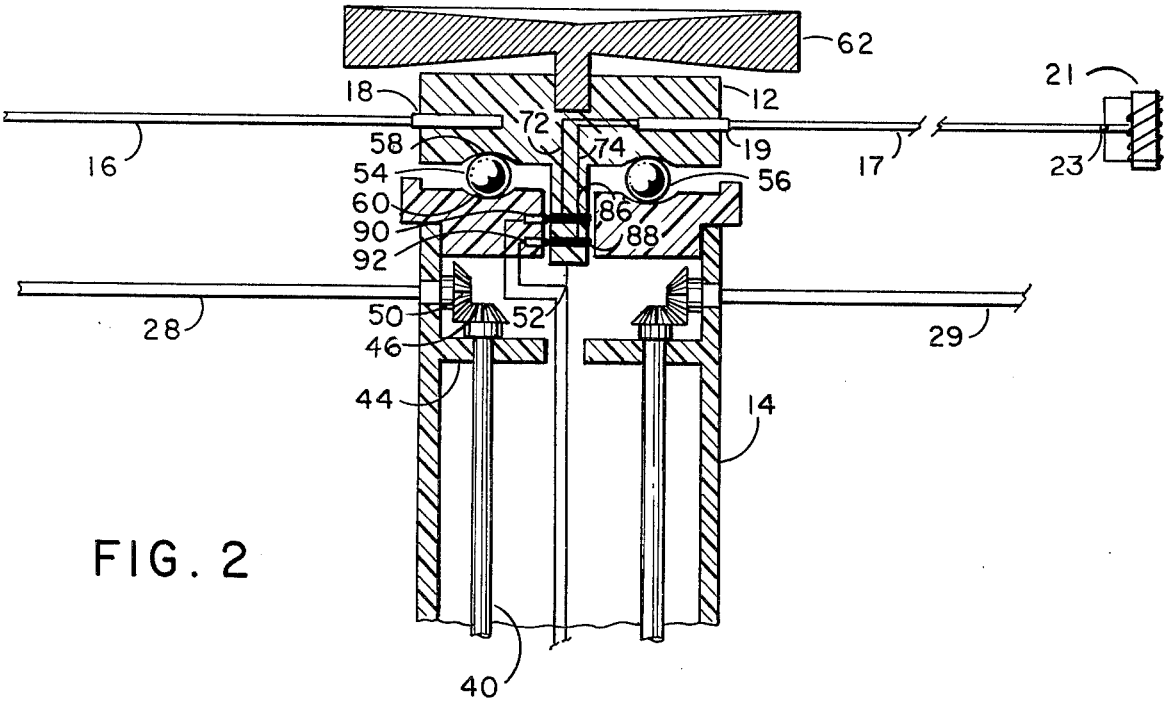
FIG. 2 illustrates a cutaway view of the neck section and pivotal member structure.

FIG. 2 illustrates a cutaway view of the neck section and pivotal member structure of the apparatus of this invention. Casing shaft 40 runs through second support member 44 and drives bevel gear 46 which is at a right angle to second bevel gear 50, the second bevel gear being affixed to lower rod 28. By turning control knob 48 illustrated in FIG. 1, a player can rotate lower bar magnet 38 illustrated in FIG. 1 mounted at the end of lower rod 28. Also seen in FIG. 2 is lower rod 29 whose rotation is controlled by a similar mechanism as that controlling lower rod 28 and is controlled by control knob 49 illustrated in FIG. 1. Also illustrated in FIG. 2 is pivotal member 12 whose pivotal member shaft 52 rotates within an aperture at the top of neck section 14. Pivotal member rods 16 and 17 are shown inserted respectively into apertures at points 18 and 19 in the periphery of pivotal member 12. Ball bearings 54 and 56 travel in upper groove 58 and lower groove 60 and assist in the rotation of pivotal member 12. Although included in the embodiment illustrated, ball bearings are not essential to the operation of this device as the device will operate without them. Further shown in FIG. 2 is cap member 62 which is mounted on pivotal member 12 and which acts as a flywheel having a greater mass near its periphery. Cap member 62 also provides additional weight to hold pivotal member 12 in position as it spins.

The bar magnets utilized in the device of this invention can be two-colored to differentiate the positive and negative poles. For example, all negative poles can be colored red and all positive poles can be colored black.

Figure 3:
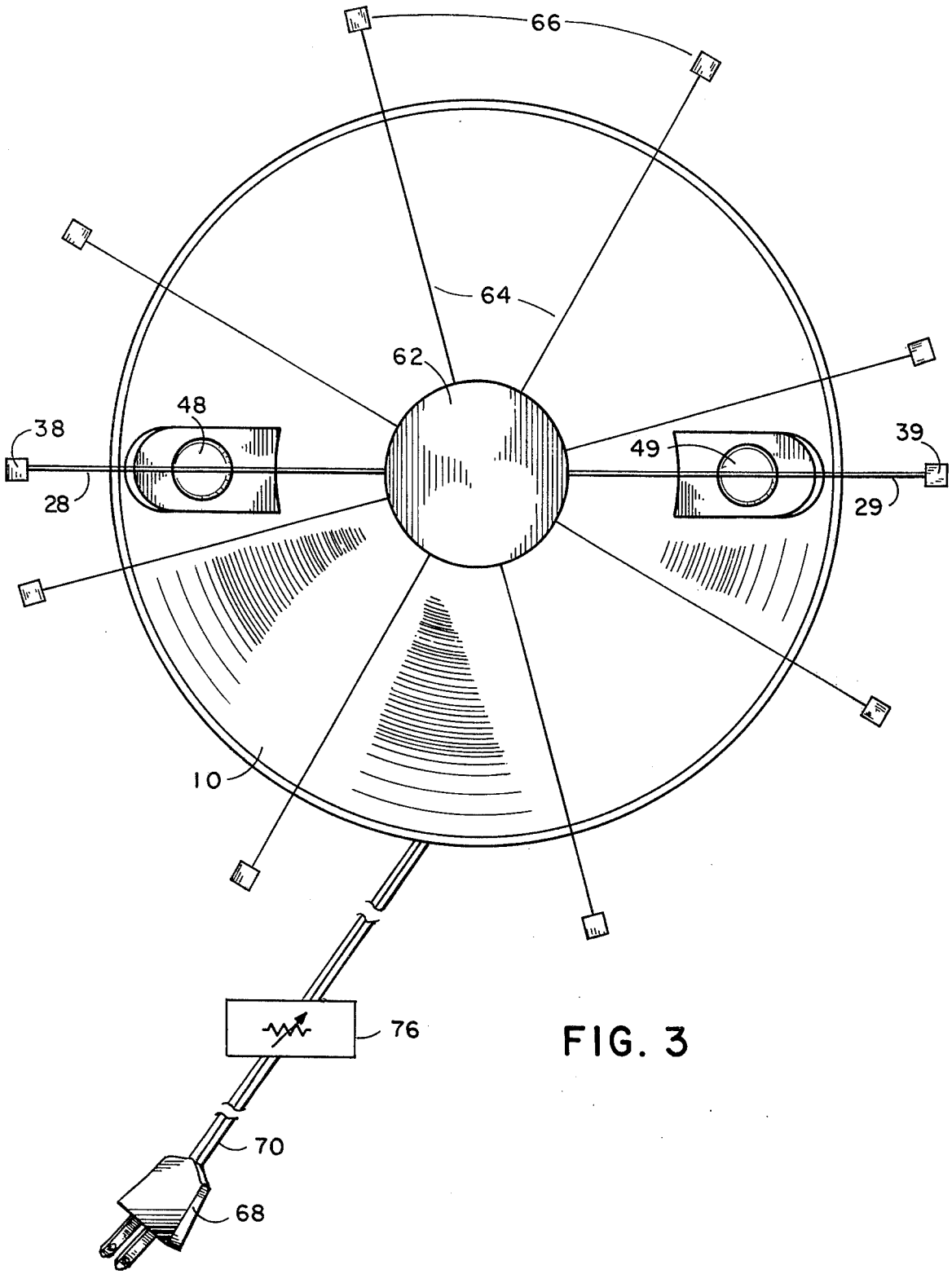
FIG. 3 illustrates a top view of the apparatus of this invention.

FIG. 3 is a top view of the device of this invention illustrating casing 10, cap member 62, and control knobs 48 and 49 controlling the rotation respectively of lower rods 28 and 29 and their associated lower bar magnets 38 and 39. Also shown is a plurality of pivotal member rods 64 and their associated pivotal member bar magnets 66.

The magnets of the apparatus of this invention can, in one embodiment, have their motive force provided by electricity. Such electromagnets would receive their power from house current, a battery, or by equivalent sources of electric current. Illustrated in FIG. 3 is electric plug 68 and two-pole wire 70 which extends into and within casing 10 and which connects with positive wire 72 and negative wire 74 illustrated in FIG. 2. In this electrically-powered embodiment either lower bar magnets 38 and 39 or pivotal member bar magnets 66 or all magnets can be electromagnets. In FIG. 2 pivotal member electromagnet 21 is illustrated. The repulsive and attractive force of the electromagnets can be increased or decreased by the manual operation of a dial-controlled variable resistor 76 shown in FIG. 3 which may be in line with the outside electrical power source. One means of creating electrical contact for the plurality of pivotal member electromagnets is illustrated in FIG. 2 where pivotal member rod 17 is hollow and extending through it to pivotal member electromagnet 21 are positive wire 72 and negative wire 74. Positive wire 72 and negative wire 74 are connected at their other ends to positive ring 86 and negative ring 88, respectively, on pivotal member shaft 52. Positive ring 86 makes contact with upper brushing 90; and negative ring 88 makes contact with lower brushing 92, said brushings being connected respectively to the positive and negative wires 72 and 74 coming from the electrical power source. In the embodiment illustrated in FIG. 2 positive and negative wires 72 and 74 emerge from inside hollow pivotal member rod 17 at point 23 and form coil of pivotal member electromagnet 21.

Although the present invention has been described with reference to particular embodiments, it will be apparent to those skilled in the art that variations and modifications can be substituted therefor without departing from the principles and spirit of the invention.

I claim:

1. A magnetic toy comprising:

a casing;

a rotatable pivotal member on top of said casing having a plurality of apertures located on its outer circumference;

a pivotal member rod, one end of which is inserted into one of said apertures;

a pivotal member bar magnet rotationally mounted at the other end of said pivotal member rod;

a neck section of said casing located below said pivotal member;

a lower rod extending out from said neck section parallel to said pivotal member rod;

a lower bar magnet mounted at the end of said lower rod positioned below said pivotal member bar magnet wherein said pivotal member bar magnet and said lower bar magnet are affected by each other's magnetic field; and means for rotating said lower rod.

2. An apparatus as recited in claim 1 further including a plurality of said pivotal member rods, one end of each inserted into one of said plurality of apertures, and a plurality of said pivotal member bar magnets each rotatably mounted at the other end of each of said pivotal member rods.

3. An apparatus as recited in claim 1 further including a plurality of said lower rods, each having a lower bar magnet mounted thereon.

4. An apparatus as recited in claim 1 wherein said means for rotating each of said lower rods and said lower bar magnets comprise:

a control knob located at the base of said casing;
a first pulley;
a control shaft connecting said control knob to the center of said first pulley;
a second pulley;
a belt connecting said first pulley to said second pulley;
a casing shaft connected to the center of said second pulley;
a first bevel gear located at the top end of said casing shaft; and
a second bevel gear interconnectively associated at a right angle to said first bevel gear forming a right angle gear, said second bevel gear attached to said lower rod so that when said control knob is turned, said lower rod rotates.

5. An apparatus as recited in claim 1 further including:

a toothed ratchet located on top of said neck section;
a pawl rotatable affixed to the lower side of said pivotal member so that said pawl engages said ratchet in one of two positions causing unidirectional movement depending upon its position and further, when said pawl is disengaged from said ratchet, said pivotal member can revolve freely in either direction.

6. An apparatus as recited in claim 1 further including ball bearings located between said pivotal member and said neck section.

7. An apparatus as recited in claim 1 wherein said bar magnets are electromagnets.

8. An apparatus as recited in claim 3 wherein the positive poles of said pivotal member bar magnets and said lower bar magnets are of a distinct color and the negative poles of said pivotal member bar magnets and said lower bar magnets are of a different color than the positive poles.

* * * * *